US009927769B2

(12) United States Patent
Shimohora et al.

(10) Patent No.: US 9,927,769 B2
(45) Date of Patent: Mar. 27, 2018

(54) IMAGE FORMING APPARATUS

(71) Applicant: KYOCERA Document Solutions Inc., Osaka (JP)

(72) Inventors: Yuya Shimohora, Osaka (JP); Mitsuki Hattori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/606,563

(22) Filed: May 26, 2017

(65) Prior Publication Data

US 2017/0343961 A1 Nov. 30, 2017

(30) Foreign Application Priority Data

May 31, 2016 (JP) ..... 2016-108924

(51) Int. Cl.

| | |
|---|---|
| ***G03G 15/00*** | (2006.01) |
| ***G03G 21/00*** | (2006.01) |
| ***G03G 21/20*** | (2006.01) |

(52) U.S. Cl.

CPC ..... *G03G 21/206* (2013.01)

(58) Field of Classification Search

CPC ..... G03G 21/206

See application file for complete search history.

(56) References Cited

U.S. PATENT DOCUMENTS

2011/0311261 A1* 12/2011 Yamashita ..... G03G 15/0887 399/92

FOREIGN PATENT DOCUMENTS

| | | |
|---|---|---|
| JP | 2010-188676 A | 9/2010 |
| JP | 2010-210729 A | 9/2010 |

* cited by examiner

*Primary Examiner* — Clayton E Laballe
*Assistant Examiner* — Michael Harrison
(74) *Attorney, Agent, or Firm* — Stein IP, LLC

(57) ABSTRACT

An image forming apparatus has a cooler, an air passage switching member, a swing mechanism, a drive gear train, and a restricting mechanism. The air passage switching member is swingable and switches the path of cooling air produced by the cooler. The swing mechanism swings the air passage switching member. The drive gear train transmits a rotation driving force to the swing mechanism. The restricting mechanism restricts the swinging range of the swing mechanism. The swing mechanism has a first gear coupled to the drive gear train, and an actuator swingably coupled to the first gear with a predetermined load and coupled to the air passage switching member. By swinging the actuator together with the first gear while restricting the swinging range of the actuator with the restricting mechanism, the air passage switching member is switched between a first position and a second position.

9 Claims, 8 Drawing Sheets

IMAGE FORMING APPARATUS

INCORPORATION BY REFERENCE

This application is based upon and claims the benefit of priority from the corresponding Japanese Patent Application No. 2016-108924 filed on May 31, 2016, the entire contents of which are incorporated herein by reference.

BACKGROUND

The present disclosure relates to an image forming apparatus exploiting electrophotography, such as a copier, a printer, a facsimile machine, or a multifunction peripheral thereof. More particularly, the present disclosure relates to an image forming apparatus incorporating a cooler that cools a photosensitive member, a developing device, and the like arranged near a fixing part.

In conventional image forming apparatuses exploiting electrophotography, such as printers, copiers, and facsimile machines, a thermal fixing method is widely used whereby a sheet that carries an unfixed toner image thereon is inserted through a nip between a heating member such as a heating roller or a heating belt and a pressing member which presses against the heating member with a predetermined pressure, and thereby the toner image is fixed to the sheet.

In such image forming apparatuses, a developing device and the like arranged around a fixing part may be adversely affected by heat released from the fixing part. To cope with that, a cooling mechanism is needed in the image forming apparatuses. Commonly, in cooling mechanisms, cooling air is blown by use of a cooling fan, and the challenge is how to achieve efficient blowing of cooling air.

For example, by use of an electric motor such as a motor or a solenoid, the path of cooling air is switched between during printing and during its preparation. For another example, a cooler is provided for preventing image forming units such as a photosensitive drum and a developing device from being exposed to high heat from a fixing device. When a drum cover which protects the surface of the photosensitive drum is retracted, the drum cover is located in the flow of cooling air produced by the cooler.

SUMMARY

According to one aspect of the present disclosure, an image forming apparatus includes a cooler, an air passage switching member, a swing mechanism, a drive gear train, and a restricting mechanism. The cooler produces cooling air. The air passage switching member is swingable, and switches the path of cooling air produced by the cooler. The swing mechanism swings the air passage switching member. The drive gear train transmits a rotation driving force to the swing mechanism. The restricting mechanism restricts the swinging range of the swing mechanism. The swing mechanism includes a first gear coupled to the drive gear train, and an actuator which is swingably coupled to the first gear with a predetermined load and to a swing end of which the air passage switching member is coupled. By swinging the actuator together with the first gear while restricting the swinging range of the actuator with the restricting mechanism, the air passage switching member is switched between a first position and a second position swung by a predetermined angle from the first position.

Further features and advantages of the present disclosure will become apparent from the description of embodiments given below.

DETAILED DESCRIPTION

Figure 1:
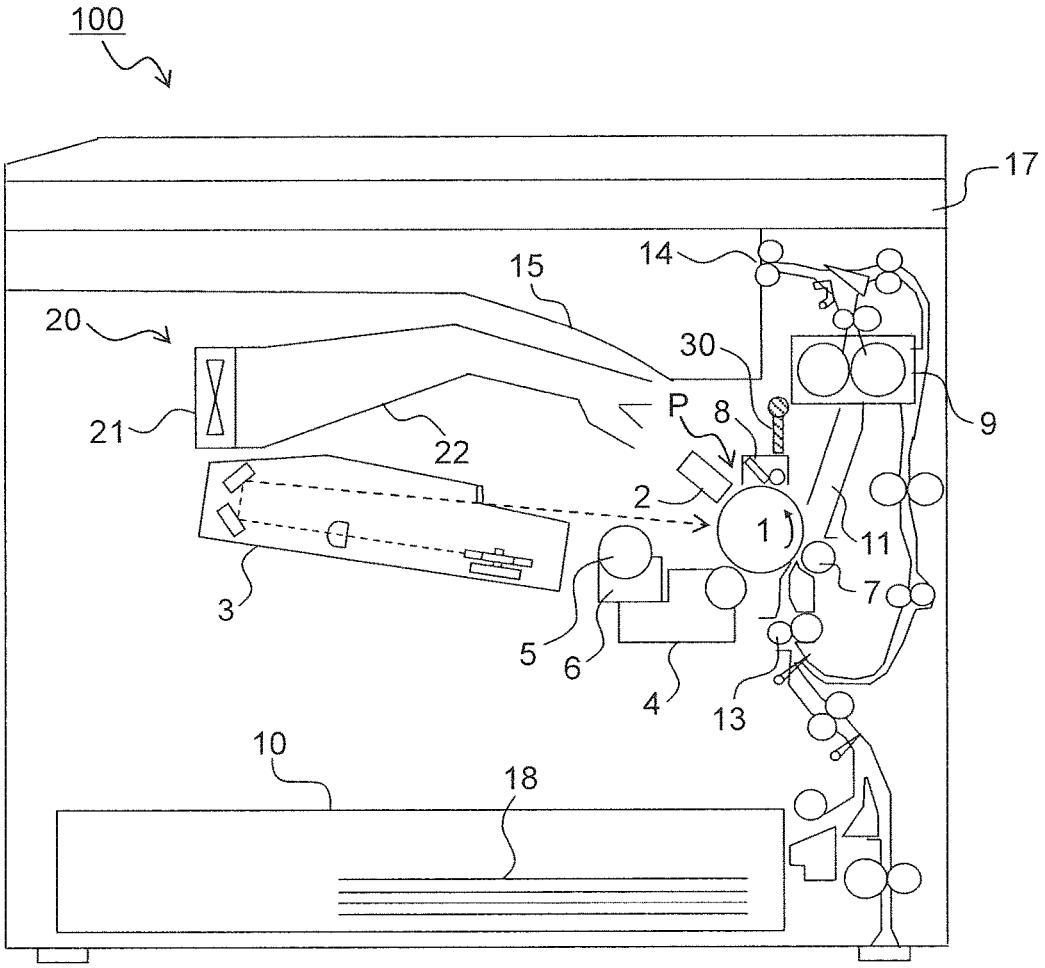
FIG. 1 is a side sectional view of a main part of an image forming apparatus according to a first embodiment of the present disclosure.

Hereinafter, embodiments of the present disclosure will be described with reference to the accompanying drawings. FIG. 1 is a schematic sectional view of an image forming apparatus 100 according to a first embodiment of the present disclosure. Here, a monochrome multifunction peripheral is shown as the image forming apparatus 100. In the main body of the image forming apparatus 100, an image forming portion P is arranged that forms a monochrome image through the processes of electrostatic charging, exposure to light, image development, and image transfer.

In the image forming portion P, there are arranged, along the rotation direction of a photosensitive drum 1 (the counter-clockwise direction in FIG. 1), a charging portion 2, an exposure unit 3, a developing device 4, a transfer roller 7, a cleaning device 8, and a destaticizer (unillustrated). In the image forming portion P, an image forming process is performed with respect to the photosensitive drum 1 while it is rotated in the counter-clockwise direction in FIG. 1.

A copy operation proceeds as follows. In an image reading portion 17, document image data is read and converted into an image signal. On the other hand, in the image forming portion P, the photosensitive drum 1 that rotates in the counter-clockwise direction in FIG. 1 is electrostatically charged uniformly by the charging portion 2. Then, the exposure unit 3 radiates a laser beam (ray of light) toward the photosensitive drum 1 based on the document image data read in the image reading portion 17, and thereby an electrostatic latent image based on the image data is formed on the surface of the photosensitive drum 1. Thereafter, the developing device 4 forms a toner image by attaching toner to the electrostatic latent image. Toner is supplied to the developing device 4 from a toner container 5 via an intermediate hopper 6.

Toward the image forming portion P having the toner image formed on it as described above, a sheet 18 is conveyed, with predetermined timing, from a sheet feed cassette 10 via a sheet conveyance passage 11 and a registration roller pair 13. Then, in the image forming portion P, the toner image on the surface of the photosensitive drum 1 is transferred to the sheet by a transfer roller 7. The sheet 18 having the toner image transferred to it is separated from the photosensitive drum 1, and is conveyed to a fixing part 9, where the toner image is fixed to the sheet 18 under application of heat and pressure. The sheet 18 having passed through the fixing part 9 is discharged via a discharge partoller pair 14 onto a discharge tray 15.

In the image forming apparatus 100, a cooler 20 is arranged over the exposure unit 3 and under the discharge tray 15. The cooler 20 has an air blowing fan 21 and a first duct 22. Between the image forming portion P and the fixing part 9, there is arranged an air passage switching member 30 that switches the path of cooling air blown out through the first duct 22. The structures of the cooler 20 and the air passage switching member 30 will be described in detail later.

Figure 2:
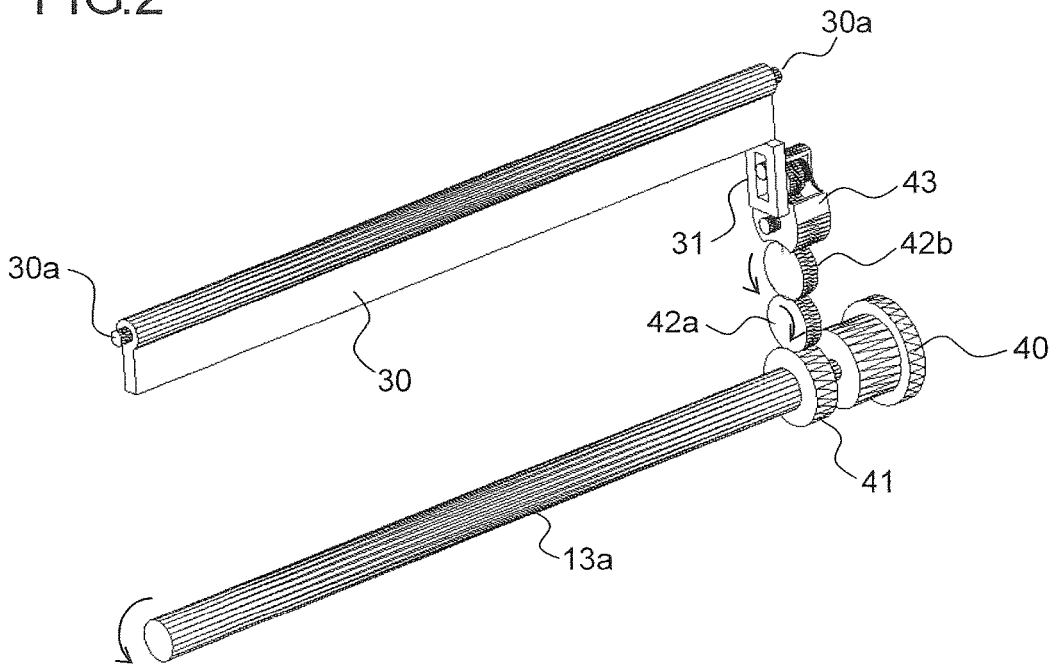
FIG. 2 is a perspective view of a driving mechanism of an air passage switching member in the image forming apparatus according to the first embodiment.

FIG. 2 is a perspective view showing a driving mechanism of the air passage switching member 30 in the image forming apparatus 100 according to the first embodiment. A registration roller 13*a* is one (the left one in FIG. 1) of the rollers constituting the registration roller pair 13, and receives a rotation driving force via a registration clutch 40.

When the registration clutch 40 is ON, the registration roller 13*a* rotates in the counter-clockwise direction in FIG. 2, and a drive output gear 41 fixed to the rotary shaft of the registration roller 13*a* rotates also in the same direction as the registration roller 13*a*. The rotation driving force of the drive output gear 41 is transmitted to a swing mechanism 43 via idle gears 42*a* and 42*b*.

The air passage switching member 30 is a flat plate-shaped member extending in the front/rear direction of the image forming apparatus 100 (the direction perpendicular to the plane of FIG. 1), and is supported on the main body of the image forming apparatus 100 so as to be swingable about swing shafts 30*a* formed in upper parts of opposite end parts of the air passage switching member 30 in its longitudinal direction. Under one end part (the registration clutch 40 side) of the air passage switching member 30 in its longitudinal direction, there is formed a link portion 31 coupled with the swing mechanism 43.

Figure 3:
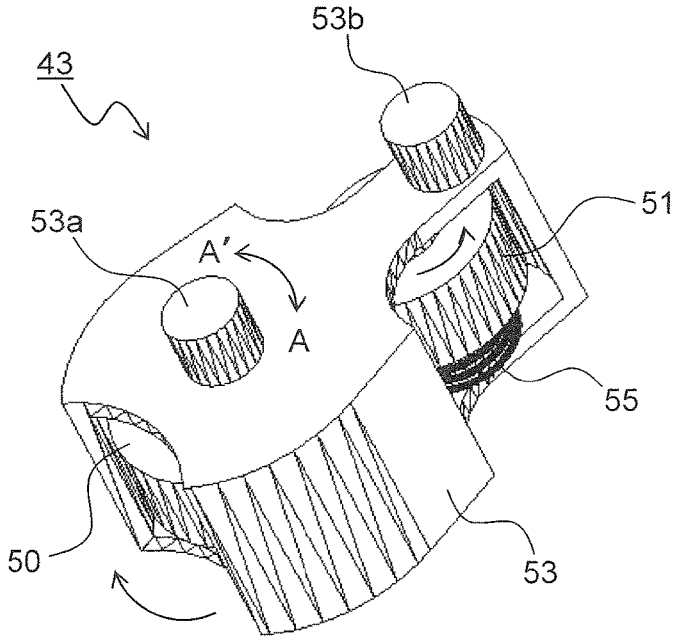
FIG. 3 is an exterior perspective view of a swing mechanism used in the image forming apparatus according to the first embodiment.

FIG. 3 is a perspective view of the swing mechanism 43 in FIG. 2. The swing mechanism 43 includes a first gear 50 which meshes with the idle gear 42*b*, a second gear 51 which meshes with the first gear 50, a gear holder 53 which rotatably holds the first and second gears 50 and 51, and a pressure spring 55 which presses the second gear 51 against the inner face of the gear holder 53.

On the outer face of the gear holder 53, a support shaft 53*a* and a coupling shaft 53*b* are formed. The support shaft 53*a* is formed about the same axis as the rotary shaft of the first gear 50, and swingably supports the gear holder 53 on the main body of the image forming apparatus 100. The coupling shaft 53*b* is arranged on the gear holder 53 near the second gear 51, and slidably engages with an oblong hole 31*a* (see FIG. 4) formed in the link portion 31 of the air passage switching member 30.

Figure 4:
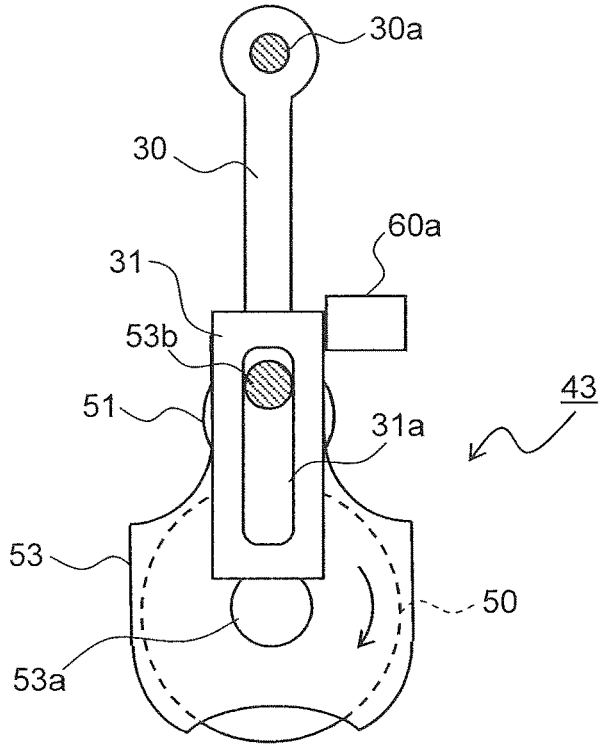
FIG. 4 is an enlarged view of the coupling part between the air passage switching member and the swing mechanism, showing a state where the air passage switching member is held in a first position.
Figure 5:
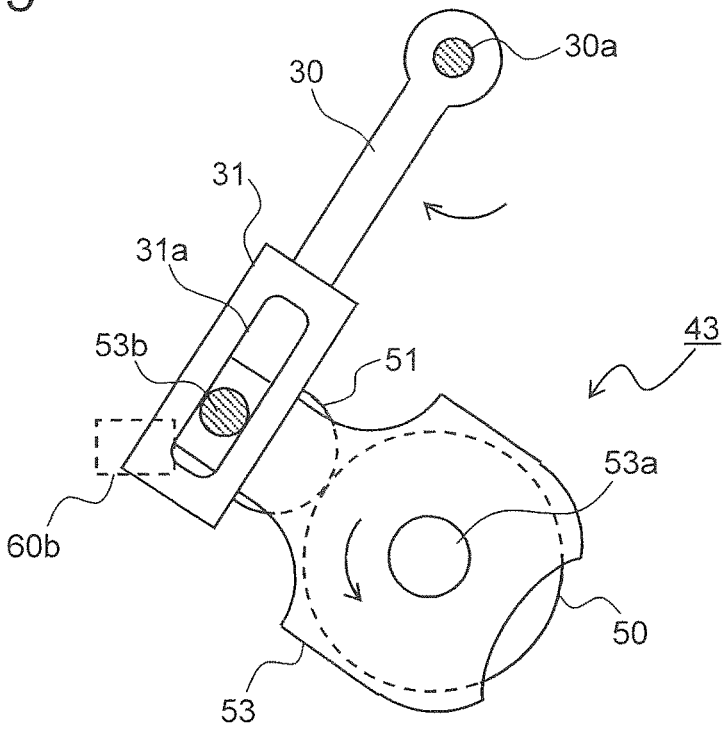
FIG. 5 is an enlarged view of the coupling part between the air passage switching member and the swing mechanism, showing a state where the air passage switching member is held in a second position.

FIGS. 4 and 5 are enlarged views of the coupling part between the air passage switching member 30 and the swing mechanism 43. With reference to FIGS. 2 and 3 as necessary, a description will be given of a procedure for switching the position of the air passage switching member 30 with reference to FIGS. 4 and 5.

When the registration clutch 40 is ON, as the registration roller 13*a* rotates in the counter-clockwise direction in FIG. 2, a rotation driving force is transmitted from the drive output gear 41 via the idle gears 42*a* and 42*b* to the first gear 50 of the swing mechanism 43. As a result, the first gear 50 rotates in the clockwise direction in FIG. 3.

As the first gear 50 rotates, to the second gear 51 which meshes with the first gear 50, a rotation driving force in the counter-clockwise direction in FIG. 3 is transmitted. Here, the second gear 51 is pressed against the inner face of the gear holder 53 by the pressure spring 55, and thus the rotation in the counter-clockwise direction is restricted. As a result, the second gear 51 moves in the direction indicated by arrow A in FIG. 3 along the circumferential surface of the first gear 50. Then, the gear holder 53 rotates, together with the second gear 51, in the direction indicated by arrow A about the support shaft 53*a* as a pivot.

As shown in FIG. 4, the gear holder 53 has its rotation restricted by making contact with a restricting member 60*a* arranged in the image forming apparatus 100, and the second gear 51 rotates idly against the friction force between it and the gear holder 53. In this way, the gear holder 53 is held in the position shown in FIG. 4. Here, the coupling shaft 53*b* of the gear holder 53 is engaged with the upper end of the oblong hole 31*a* in the link portion 31, and the air passage switching member 30 is held in a substantially vertical position (first position).

On the other hand, when a rotation driving force in the clockwise direction in FIG. 2 is fed to the registration roller 13*a*, the drive output gear 41 rotates together with the registration roller 13*a* in the clockwise direction in FIG. 2, and the rotation driving force is transmitted from the drive output gear 41 via the idle gears 42*a* and 42*b* to the first gear 50 of the swing mechanism 43. As a result, the first gear 50 rotates in the counter-clockwise direction in FIG. 3.

As the first gear 50 rotates, to the second gear 51 which meshes with the first gear 50, a rotation driving force in the clockwise direction in FIG. 3 is transmitted. Here, the second gear 51 is pressed against the inner face of the gear holder 53 by the pressure spring 55, and thus the second gear 51 moves in the direction indicated by arrow A' in FIG. 3 along the circumferential surface of the first gear 50. Then, the gear holder 53 rotates, together with the second gear 51, in the direction indicated by arrow A' about the support shaft 53*a* as a pivot.

As shown in FIG. 5, the gear holder 53 has its rotation restricted by making contact with a restricting member 60*b* arranged in the image forming apparatus 100, and the second gear 51 rotates idly against the friction force between it and the gear holder 53. In this way, the gear holder 53 is held in the position shown in FIG. 5. Here, the coupling shaft 53*b* of the gear holder 53 has moved to the lower end of the oblong hole 31*a* in the link portion 31, and the air passage switching member 30 is held in a position (second position) inclined by a predetermined angle from the first position. Here, in place of the pressure spring 55, a torque limiter may be provided on the second gear 51.

Figure 6:
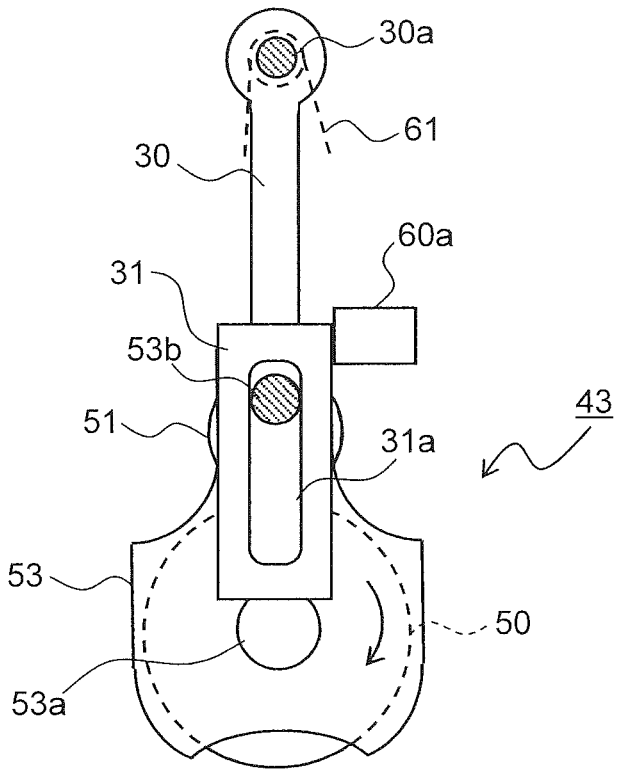
FIG. 6 is an enlarged view showing another example of the coupling part between the air passage switching member and the swing mechanism, showing a state where the air passage switching member is held in the first position.
Figure 7:
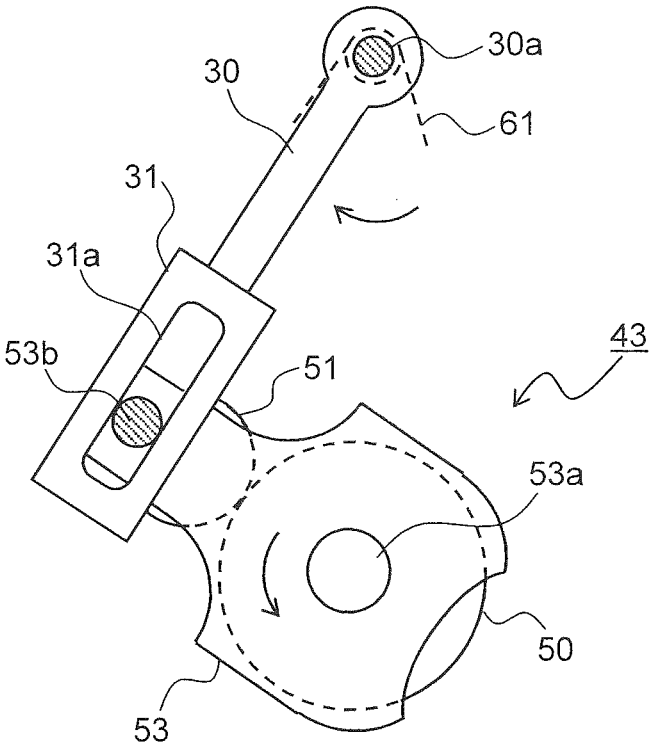
FIG. 7 is an enlarged view showing another example of the coupling part between the air passage switching member and the swing mechanism, showing a state where the air passage switching member is held in the second position.

FIGS. 6 and 7 are enlarged views showing another example of the coupling part between the air passage switching member 30 and the swing mechanism 43. In FIGS. 6 and 7, in place of the restricting member 60*b*, a torsion spring 61 is provided on the swing shaft 30*a* of the air passage switching member 30 to restrict the swinging range of the air passage switching member 30 with the biasing force of the torsion spring 61. The structures of the swing mechanism 43 and the link portion 31 are the same as in FIGS. 4 and 5.

As shown in FIG. 6, when the registration roller 13*a* has stopped being driven, the gear holder 53 is held in contact with the restricting member 60*a* by the biasing force of the torsion spring 61. When, in this state, a rotation driving force in the counter-clockwise direction in FIG. 2 is fed to the registration roller 13*a*, a force in the direction indicated by arrow A in FIG. 3 acts on the gear holder 53; still, the gear holder 53 has its rotation restricted by making contact with the restricting member 60*a*. As a result, the air passage switching member 30 is held in the first position.

When, from the state in FIG. 6, a rotation driving force in the clockwise direction in FIG. 2 is fed to the registration roller 13*a*, a force in the direction indicated by arrow A' in FIG. 3 acts on the gear holder 53, and as shown in FIG. 7, the gear holder 53 rotates in the direction indicated by arrow A' against the biasing force of the torsion spring 61. Accordingly, the air passage switching member 30 coupled to the gear holder 53 via the link portion 31 also swings in the left direction in FIG. 7. Here, the more the torsion spring 61 is deformed by the swinging of the air passage switching member 30, the stronger the biasing force (restoring force) of the torsion spring 61 that acts on the gear holder 53. Then, when the biasing force of the torsion spring 61 exceeds the friction force between the second gear 51 and the gear holder 53, the second gear 51 rotates idly, and the air passage switching member 30 stops in the second position.

With the configuration shown in FIGS. 6 and 7, stopping the transmission of a driving force to the registration roller 13*a* by turning OFF the registration clutch 40 permits the air passage switching member 30 to automatically return to the first position from the second position under the biasing force of the torsion spring 61. This makes it unnecessary to bring the air passage switching member 30 having been brought into the second position back into the first position by rotating the registration roller 13*a* in the counter-clockwise direction in FIG. 2, and thus makes the switching procedure simple.

Figure 8:
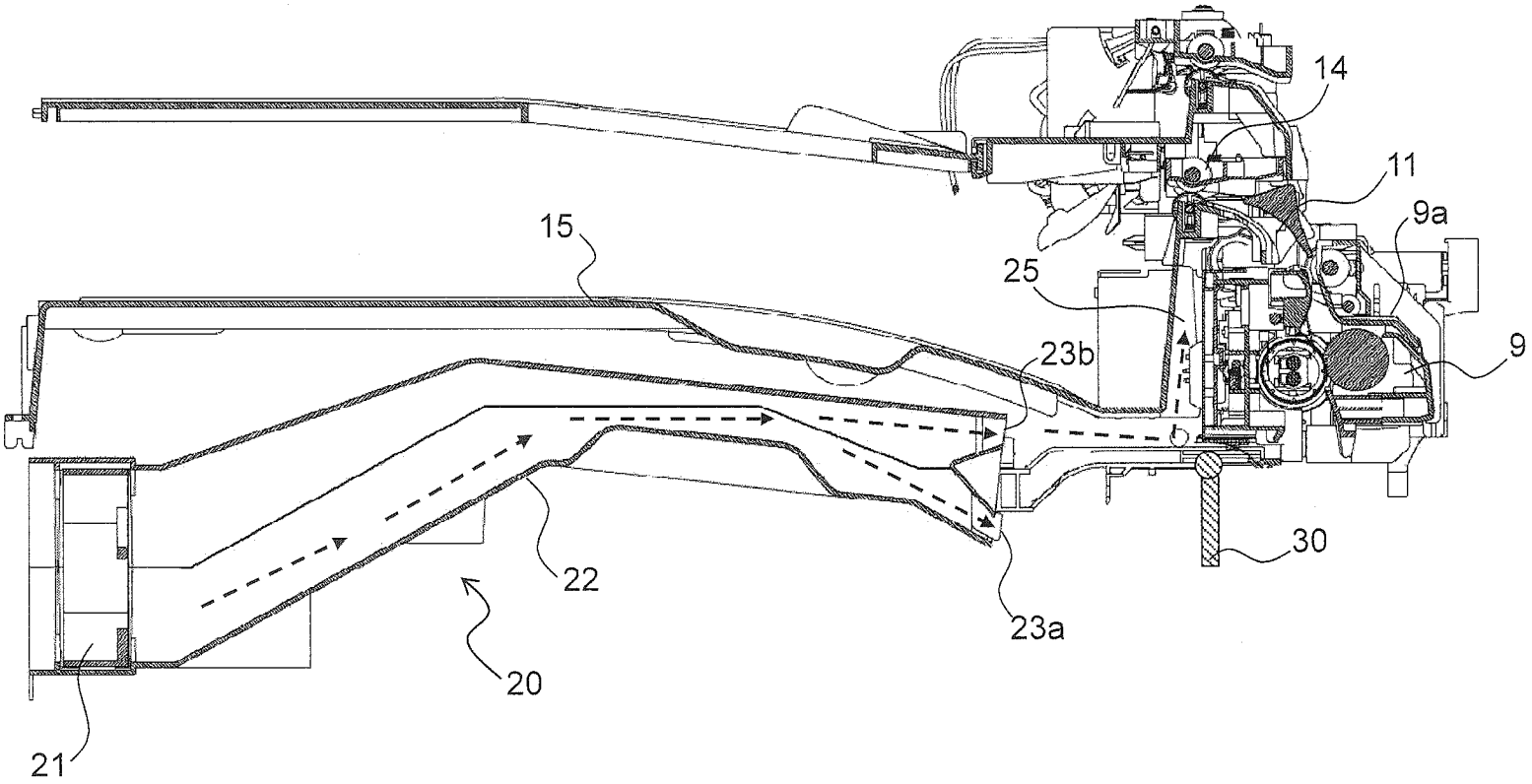
FIG. 8 is a side sectional view showing the structure around a cooler in the image forming apparatus according to the first embodiment, showing a state where an air passage is cut off by the air passage switching member.

FIG. 8 is a side sectional view showing the structure around the cooler 20 in the image forming apparatus 100 according to this embodiment. The arrangement and the structure of the cooler 20 will be described with reference to FIGS. 1 and 8. The cooler 20 cools the image forming portion P having arranged therein the photosensitive drum 1, the developing device 4, the cleaning device 8, and the like to which heat dispersed from the fixing part 9 is transmitted, and a sheet 18 conveyed through the sheet conveyance passage 11.

As shown in FIG. 8, the cooler 20 has the air blowing fan 21 and the first duct 22. The air blowing fan 21 is a suction fan which sucks air outside the main body of the image forming apparatus 100. The air taken in by the air blowing fan 21 passes through the first duct 22, and is blown to first and second discharge holes 23*a* and 23*b*.

The cooling air discharged through the first discharge hole 23*a* is blown to around the developing device 4. Thus, the fluidity of toner in the developing device 4 can be prevented from lowering due to the heat of the fixing part 9.

The cooling air discharged through the second discharge hole 23*b* flows upward through the second duct 25, which is formed between a side surface of a main body frame to which a housing 9*a* of the fixing part 9 is fitted and the inner wall surface of the main body of the image forming apparatus 100, and is blown into the sheet conveyance passage 11, which connects between the fixing part 9 and the discharge partoller pair 14. This cools a sheet 18 moving toward the discharge partoller pair 14 after passing through the fixing part 9 and toner fused by the heat of the fixing part 9, and thus it is possible to suppress attachment of toner to the sheet conveyance passage 11 and the discharge partoller pair 14. When a sheet 18 having absorbed moisture passes through the fixing part 9, water vapor may be released from the heated sheet 18, rising in the form of steam; however, as a result of cooling air being blown from the second duct 25 into the sheet conveyance passage 11, the water vapor diffuses. This eliminates the danger of a user mistakenly recognizing it as smoke.

In this embodiment, the position of the air passage switching member 30 is switched according to the status of the image forming apparatus 100. For example, when an image is formed, the registration roller 13*a* is rotated in the forward direction (the counter-clockwise direction in FIG. 2) by turning ON the registration clutch 40. As a result, as shown in FIG. 8, while a sheet 18 is conveyed from the registration roller pair 13 to the image forming portion P, the air passage switching member 30 is held in the first position to cut off the air passage between the image forming portion P and the fixing part 9.

Thus, the cooling air discharged through the second discharge hole 23*b*, without being blown to under the fixing part 9, passes upward through the second duct 25, and is efficiently guided to the sheet conveyance passage 11. Thus, it is possible to effectively cool a sheet 18 that is conveyed to the discharge partoller pair 14 after passing through the fixing part 9, and to suppress contamination of the sheet conveyance passage 11 and the discharge partoller pair 14 resulting from fused toner attaching to them.

It is also possible to prevent cooling air from entering the fixing part 9 from the second discharge hole 23*b*, and thus to suppress an electric power loss occurring as a result of a fixing roller in the fixing part 9 being cooled.

Figure 9:
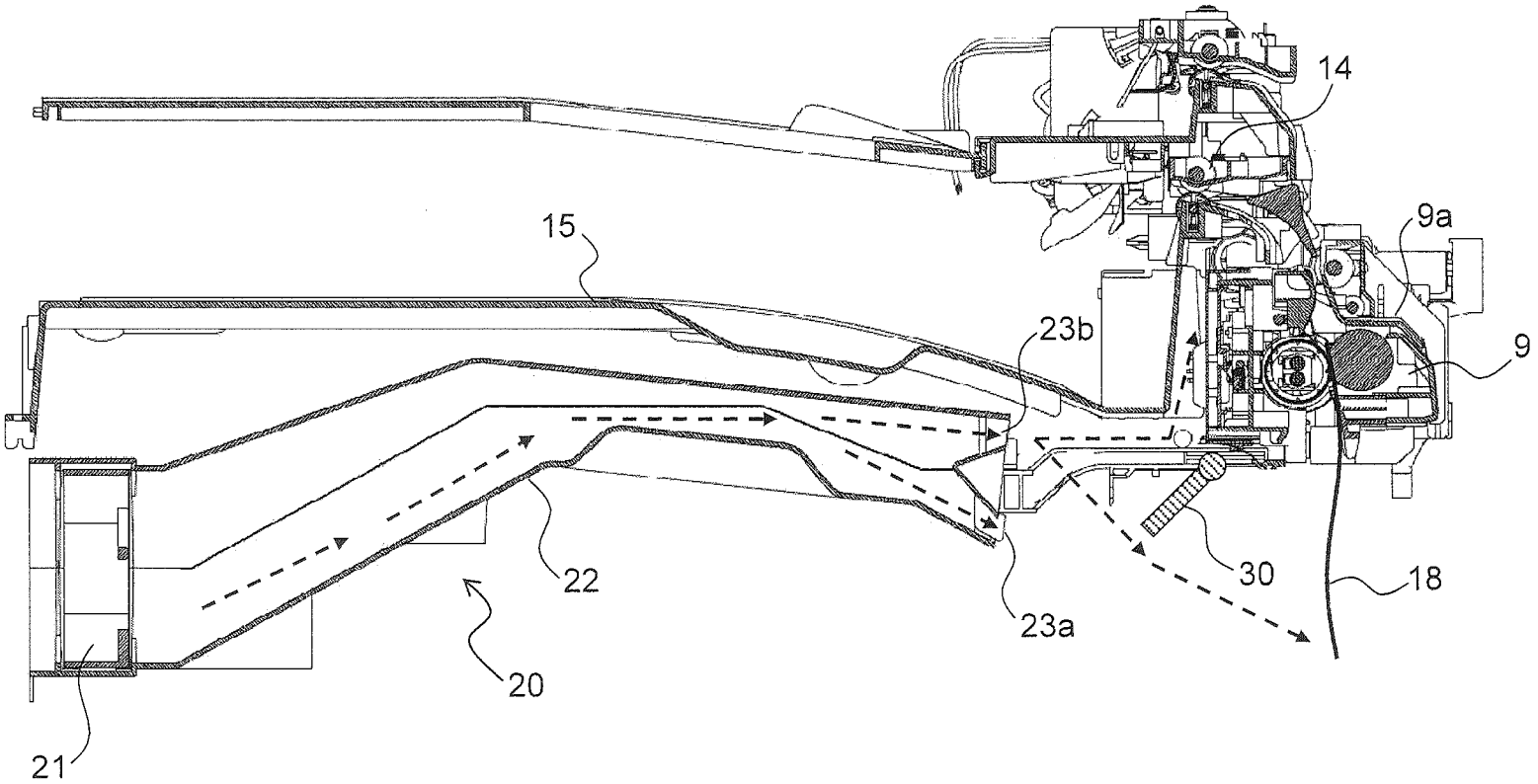
FIG. 9 is a side sectional view showing the structure around the cooler in the image forming apparatus according to the first embodiment, showing a state where the air passage is open by the air passage switching member.

After the tail end of the sheet 18 passes through the registration roller pair 13, the drive output gear 41 is rotated in the reverse direction only for a short time. This, as shown in FIG. 9, temporarily switches the air passage switching member 30 to the second position to open the air passage between the image forming portion P and the fixing part 9. As a result, the cooling air is blown to the tail end of the sheet 18 having passed through a transfer nip, and thus the tail end of the sheet 18 can be prevented from flapping. Thereafter, by immediately bringing the air passage switching member 30 back in the first position from the second position, it is possible to minimize cooling air that flows into the fixing part 9.

Figure 10:
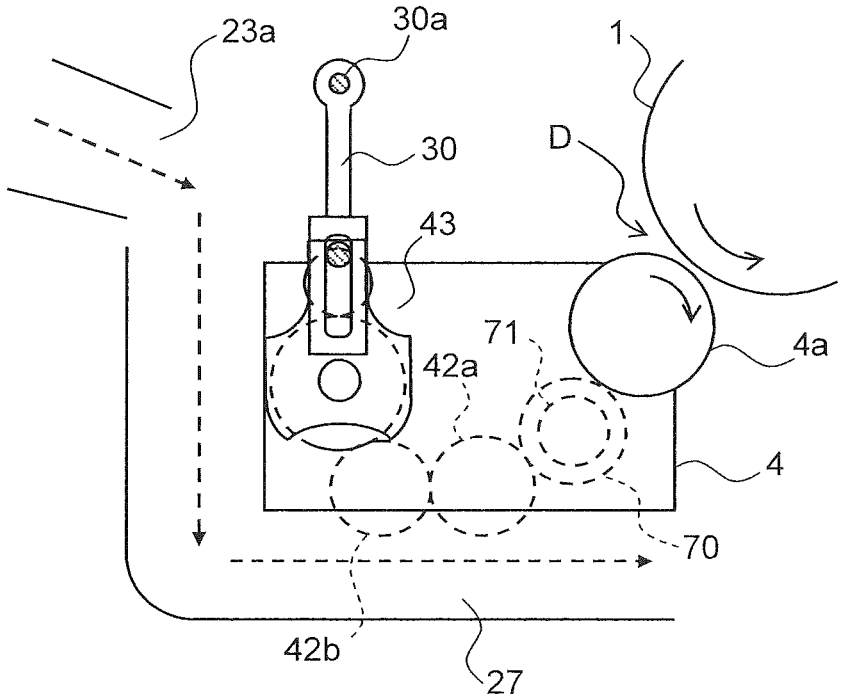
FIG. 10 is a side sectional view showing the structure around a developing device in an image forming apparatus according to a second embodiment of the present disclosure, showing a state where an air passage is cut off by an air passage switching member.
Figure 11:
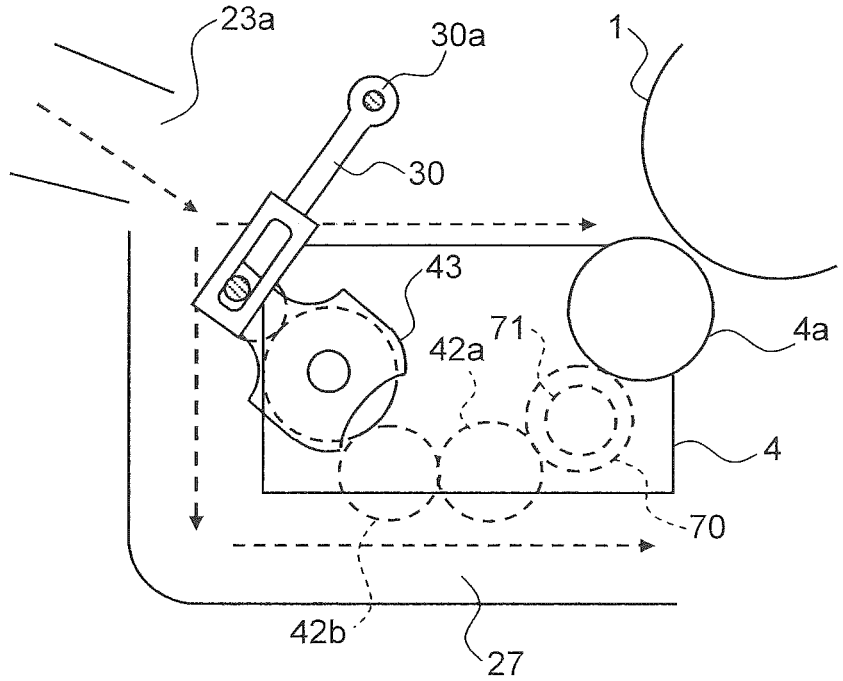
FIG. 11 is a side sectional view showing the structure around the developing device in the image forming apparatus according to the second embodiment, showing a state where the air passage is open by the air passage switching member.

FIGS. 10 and 11 are side sectional views showing the structure around the developing device 4 in an image forming apparatus 100 according to a second embodiment of the present disclosure. In this embodiment, the first duct 22 extends to close to the developing device 4, and the first discharge hole 23*a* is provided obliquely above the developing device 4. There is also formed a third duct 27 leading to the first discharge hole 23*a*. Part of the third duct 27 is formed by a side surface and a bottom surface of the developing device 4. The air passage switching member 30 is arranged between a region (developing region D), where the photosensitive drum 1 and the developing roller 4*a* face each other, and the first discharge hole 23*a*.

To the developing roller 4*a*, a developing drive gear 70 is coupled, and a driving force is fed via a developing clutch 71. The swing mechanism 43 is coupled to the developing drive gear 70 via the idle gears 42*a* and 42*b*.

As shown in FIG. 10, when an image is formed, by rotating the developing drive gear 70 by turning ON the developing clutch 71, the air passage switching member 30 is held in the first position by the swing mechanism 43. Thus, the cooling air through the first discharge hole 23*a*, without being blown to the developing region D, passes through the third duct 27, and is blown to the bottom of the developing device 4. Thus, it is possible to suppress toner scattering in the developing region D and image defects resulting from it.

On the other hand, as shown in FIG. 11, when no image is formed, by turning OFF the developing clutch 71 after rotating the developing drive gear 70 in the reverse direction, the air passage switching member 30 is held in the second position. Thus, the cooling air through the first discharge hole 23*a* passes through the third duct 27, and is blown to the bottom of the developing device 4; simultaneously the cooling air passes over a top surface of the developing device 4, and is blown also to the developing region D. Thus, it is possible to efficiently cool the entire developing device 4.

In this embodiment, when the torsion spring 61 (see FIGS. 6 and 7) is provided on the swing shaft 30*a* of the air passage switching member 30, in place of the restricting member 60*a*, the restricting member 60*b* may be provided such that the gear holder 53 is held in contact with the restricting member 60*b* by the biasing force of the torsion spring 61. In this way, when the developing clutch 71 is turned OFF, the air passage switching member 30 is automatically held in the second position under the biasing force of the torsion spring 61.

The embodiments described above are in no way meant to limit the present disclosure, which thus allows for many modifications and variations within the spirit of the present disclosure. For example, the swing mechanism 43 is not limited to a configuration like the one shown in FIG. 3; it may instead adopt a configuration like the one shown in FIG. 12.

Figure 12:
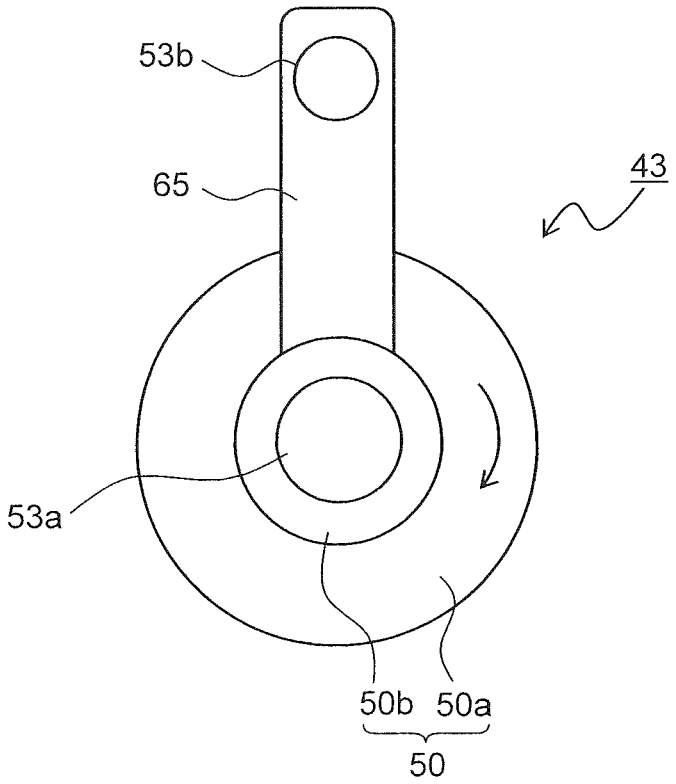
FIG. 12 is a diagram showing another example of the structure of a swing mechanism used in an image forming apparatus of the present disclosure.

In FIG. 12, the first gear 50 included in the swing mechanism 43 is composed of an outer diameter portion 50*a* and an inner diameter portion 50*b* which rotate about the support shaft 53*a*. The inner diameter portion 50*b* incorporates a torque limiter (unillustrated), and when a predetermined load or heavier is applied to it, the outer diameter portion 50*a* and the inner portion 50*b* rotate independently of each other. The inner portion 50*b* is formed integrally with an arm 65, and on a tip end of the arm 65, the coupling shaft 53*b* is formed which engages with the oblong hole 31*a* in the link portion 31.

By use of the swing mechanism 43 shown in FIG. 12, the arm 65 swings in a manner coordinated with the rotation of the first gear 50. When a predetermined load or heavier is applied by the biasing force of the restricting member 60*a*, the restricting member 60*b*, or the torsion spring 61, the inner diameter portion 50*b* rotates idly and the arm 65 is held in a predetermined position. Thus, the air passage switching member 30 coupled to the arm 65 via the link portion 31 can be switched between the first and second positions.

Although the above-described embodiments deal with an example where the air blowing fan 21 is a suction fan, this is in no way meant to limit the present disclosure. Instead, the air blowing fan 21 may be a discharge fan so that hot air around the photosensitive drum 1, the developing device 4, cleaning device 8, and the sheet conveyance passage 11 is discharged out of the main body of the image forming apparatus 100 by the air blowing fan 21 via the first duct 22. Although the above-described embodiments deal with an example where the first duct 22 branches to two discharge holes, namely the first discharge hole 23*a* and the second discharge hole 23*b*, this is in no way meant to limit the present disclosure; it may instead branch to three or more discharge holes.

Although in the above-described embodiments, the swing mechanism 43 is coupled to the drive output gear 41, which is fixed to the registration roller 13*a*, or to a drive gear train, which is coupled to the developing drive gear 70 that feeds a driving force to the developing roller 4*a*, this is not meant as any limitation. Instead, the swing mechanism 43 can be coupled to a gear that drives any other rotary member in the image forming apparatus 100.

The present disclosure is applicable, not only to monochrome printers like the one shown in FIG. 1, but also to various image forming apparatuses incorporating a cooler that cools the inside of the apparatus with cooling air, such as color printers, monochrome and color copiers, and facsimile machines.

The present disclosure is applicable to image forming apparatuses exploiting electrophotography, such as copiers, printers, facsimiles, and multifunctional peripherals thereof. Based on the present disclosure, it is possible to provide an image forming apparatus that can switch the path of cooling air produced in a cooler with a simple configuration.

What is claimed is:

1. An image forming apparatus comprising:

a cooler which produces cooling air;

an air passage switching member which is swingable, the air passage switching member switching a path of the cooling air produced by the cooler;

a swing mechanism which swings the air passage switching member;

a drive gear train which transmits a rotation driving force to the swing mechanism; and a restricting mechanism which restricts a swinging range of the swing mechanism, wherein the swing mechanism includes a first gear coupled to the drive gear train and an actuator which is swingably coupled to the first gear with a predetermined load and to a swing end of which the air passage switching member is coupled, and the swing mechanism, by swinging the actuator together with the first gear while restricting a swinging range of the actuator with the restricting mechanism, switches the air passage switching member between a first position and a second position swung by a predetermined angle from the first position.

2. The image forming apparatus of claim 1, wherein the restricting mechanism has a pair of restricting members that make contact with the actuator at opposite ends of the swinging range of the actuator, and when the drive gear train is rotated in the forward/reverse direction, the actuator is put in contact with one of the pair of restricting members and the air passage switching member is held in the first position or the second position.

3. The image forming apparatus of claim 1, wherein the restricting mechanism has a restricting member which makes contact with the actuator at one end of the swinging range of the actuator and a biasing member which biases the actuator in a direction approaching the restricting member, when the drive gear train is rotated in a forward direction or is stopped, the actuator is put in contact with the restricting member by a biasing force of the biasing member and the air passage switching member is held in one of the first position and the second position, and when the drive gear train is rotated in a reverse direction, the actuator is moved away from the restricting member against the biasing force of the biasing member and the air passage switching member is held in another one of the first position and the second position.

4. The image forming apparatus of claim 1, wherein the actuator includes a gear holder supported rotatably about a support shaft on a same axis as a rotary shaft of the first gear, a second gear supported rotatably on the gear holder, the second gear meshing with the first gear, and a load applying member which applies a rotation load to the second gear, and when the swinging range of the actuator is restricted by the restricting mechanism, the second gear rotates idly and the air passage switching member is held in the first position or the second position.

5. The image forming apparatus of claim 4, wherein the load applying member is a pressure spring which presses the second gear against an inner face of the gear holder.

6. The image forming apparatus of claim 1, wherein the first gear is composed of an outer diameter portion and an inner diameter portion that rotate independently of each other when a predetermined load or heavier is applied to the first gear, the actuator is an arm formed integrally with the inner diameter portion, and when a swinging range of the arm is restricted by the restricting mechanism, the inner diameter portion rotates idly and the air passage switching member coupled to the arm is switched between the first position and the second position.

7. The image forming apparatus of claim 1, further comprising:

an image carrying member on a surface of which an electrostatic latent image is formed;

a transfer part which transfers a toner image formed on the surface of the image carrying member to a recording medium;

a feeder which feeds the recording medium to the transfer part;

a fixing part which heats and presses the recording medium having the toner image transferred thereto in the transfer part, thereby fixing the toner image to the recoding medium;

a discharge part which discharges the recording medium having the toner image fixed thereto by the fixing part;

a recording medium conveyance passage through which the recording medium is conveyed from the feeder to the discharge part;

a registration roller pair provided in the recording medium conveyance passage leading from the feeder to the transfer part; and a registration clutch which turns ON and OFF transmission of a driving force to the registration roller pair, wherein the drive gear train is coupled to a drive output gear provided on a rotary shaft of the registration roller pair, and by turning ON the registration clutch and rotating the drive output gear together with the registration roller pair in a forward direction, while the recording medium is conveyed from the registration roller pair to the transfer part, the air passage switching member is held in the first position to cut off the path of the cooling air between the transfer part and the fixing part.

8. The image forming portion of claim 7, wherein by rotating the drive output gear together with the registration roller pair in a reverse direction for a predetermined time after a tail end of the recording medium has passed through the registration roller pair, the air passage switching member is switched to the second position to open the path of the cooling air between the transfer part and the fixing part.

9. The image forming portion of claim 1, further comprising:

a developing device which develops an electrostatic latent image formed on a surface of an image carrying member into a toner image; and a developing clutch which turns ON and OFF transmission of a driving force to the developing device, wherein the drive gear train is coupled to a developing drive gear which feeds a driving force to the developing device, when an image is formed, by turning ON the developing clutch and rotating the developing drive gear, the air passage switching member is held in the first position to cut off the path of the cooling air moving toward a region where the developing device and the image carrying member face each other, and when no image is formed, the air passage switching member is held in the second position to open the path of the cooling air moving toward the region where the developing device and the image carrying member face each other.

* * * * *